United States Patent [19]

Coffey et al.

[11] 3,968,004

[45] July 6, 1976

[54] PROCESS FOR MAKING A SHAPED FIBROUS ARTICLE BY A VACUUM FORMING PROCESS AND THE SHAPED FIBROUS ARTICLE MADE THEREBY

[75] Inventors: Fred Simms Coffey, Bradford; Harold Lloyd Weaver, Port Allegany; Howard Beattie Johnson, Bradford, all of Pa.

[73] Assignee: Pittsburgh Corning Corporation, Pittsburgh, Pa.

[22] Filed: Nov. 21, 1973

[21] Appl. No.: 417,976

[52] U.S. Cl. ..... 162/152; 162/181 D; 162/218; 162/221; 162/222; 162/228

[51] Int. Cl.[2] ..... D21F 11/00

[58] Field of Search ..... 162/152, 218, 228, 384, 162/382, 389, 119, 181 D, 221, 222, 387, 266; 264/108, 114; 425/84, 85, 86, 87

[56] References Cited

UNITED STATES PATENTS

| | | | |
|---|---|---|---|
| 1,551,257 | 8/1925 | Little | 162/228 |
| 2,124,745 | 7/1938 | Morgan | 162/384 |
| 2,383,066 | 4/1945 | McDermott | 162/145 |
| 2,700,326 | 1/1955 | Curtis | 162/228 |
| 2,732,295 | 1/1956 | Hollenberg | 162/152 |
| 3,028,911 | 4/1962 | De Lear | 162/228 |
| 3,093,533 | 6/1963 | Hella et al. | 162/152 |
| 3,585,107 | 5/1967 | Williams | 162/387 |

*Primary Examiner*—Robert L. Lindsay, Jr.
*Assistant Examiner*—Peter Chin
*Attorney, Agent, or Firm*—Stanley J. Price, Jr.

[57] ABSTRACT

A dilute slurry that includes mineral wool fibers, a clay binder, other binders and a flocculent is introduced into a forming tank at several elevations and with sufficient velocity to circulate toroidally therein. A mandrel having the desired configuration of one surface of the shaped article is lowered into the forming tank and rotated at a preselected speed. Vacuum is applied to the rotating mandrel and a substantially uniform layer of solids is deposited on the outer surface of the mandrel while the filtrate is withdrawn through an internal portion of the mandrel and conveyed to a filtrate recovery tank. After a layer of a preselected thickness is deposited on the outer surface of the mandrel, the mandrel is removed from the forming tank and vacuum is maintained on the mandrel to reduce the water content of the accreted fibers to between about 40 to 65% by weight water. Thereafter, while on the mandrel, the accreted fiber-shaped article is trimmed to provide an outer surface of a desired configuration. The trimmed article is thereafter sprayed with a coating material while vacuum is maintained on the mandrel so that the coating material penetrates the surface of the shaped article. The shaped article is thereafter removed from the mandrel and trimmed to provide a fibrous shaped article having a desired configuration and thickness.

11 Claims, 2 Drawing Figures

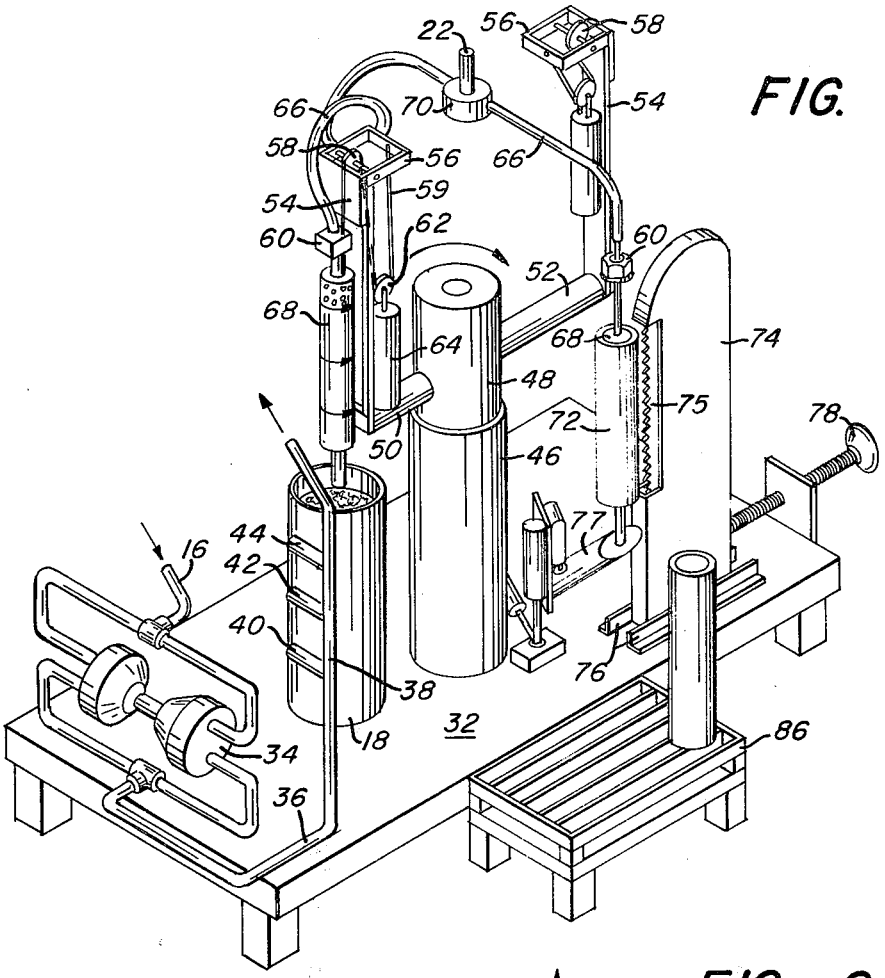
FIG. 1
FIG. 2
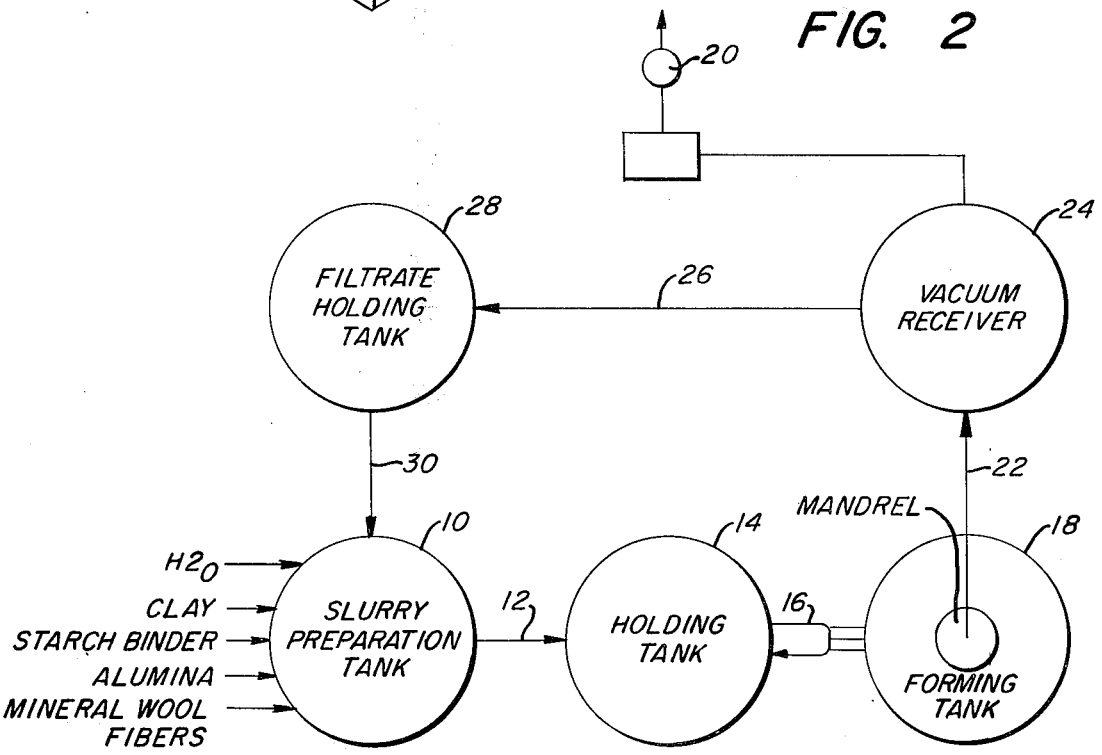

PROCESS FOR MAKING A SHAPED FIBROUS ARTICLE BY A VACUUM FORMING PROCESS AND THE SHAPED FIBROUS ARTICLE MADE THEREBY

BACKGROUND OF THE INVENTION

1. Field of the Invention

This invention relates to a shaped fibrous article and a process for making the shaped fibrous article having a preselected configuration and thickness by a vacuum forming process and more particularly to a shaped fibrous article and the process for making the shaped fibrous article by a vacuum forming process in which a substantial portion of the fibers are oriented substantially parallel to the forming surface.

2. Description of the Prior Art

U.S. Pat. Nos. 2,539,767; 2,700,326; 3,028,911 and 3,442,757 disclose both methods and apparatus for forming filter elements from a fibrous slurry. In U.S. Pat. No. 2,539,767 a filter element with a graduated porosity is obtained by controlling the degree of vacuum and the length of time over which the vacuum is applied to the accreted fibers. U.S. Pat. No. 2,700,326 discloses a process for progressively elevating a shaped tube around the foraminous former to obtain a uniform accreted filter element. U.S. Pat. No. 3,442,757 discloses a process for positioning a cylindrical element over the former to control the density and size of the accreted filter. U.S. Pat. No. 3,028,911 suggests subjecting the forming tank to a pressure during the accretion of the fiber on the forming tube.

U.S. Pat. No. 1,859,325 discloses apparatus for making cylindrically shaped articles from paper pulp by accretion on the forming tube. The exterior surface of the accreted pulp element is pressed between two cylinders to remove additional water. U.S. Pat. No. 2,107,779 discloses a method and apparatus for producing fiber pipe insulation that includes a cylindrical mold having an outer foraminous surface. The mold is agitated and vibrated while a slurry of the mineral fiber and binder is introduced into the mold. The mold is thereafter rotated at a high speed to further extract water from the fibrous material deposited within the mold.

U.S. Pat. No. 2,101,921 discloses a method and apparatus for forming mineral wool insulation by moving a foraminous mandrel in a direction normal to its axis through a bath containing mineral fibers. When a layer of mineral fibers having desired thickness is deposited on the outer surface of the mandrel, the mandrel is moved into abutting relation with an inclined surface where the deposited fibers are compressed and shaped. Thereafter, while remaining on the mandrel the deposited fibers are dried in an oven.

U.S. Pat. No. 3,371,134 discloses a method for making a water laid sheet from a slurry that consists essentially of water, an inorganic wool and a clay. The water laid sheet is dried to remove the water and is fired at a temperature of between 1,000° and 1,600°F. to form a ceramic bond. U.S. Pat. Nos. 3,470,062 and 3,549,485 are also directed to a method of making water laid sheet from a slurry of inorganic wool and a clay and disclose additives such as alumina, starch, flocculents and de-flocculents.

There is a need for a simple and inexpensive process for making a mineral fiber insulation product and particularly pipe insulation having a substantial portion of the fiber oriented to provide the desired physical strength and insulating properties and does not require the elaborate external shaping apparatus or agitating and vibrating the mandrel during the accretion of the mineral fibers or shaping and drying the mineral fiber insulation in an oven while the insulation remains on the mandrel.

SUMMARY OF THE INVENTION

This invention relates to a process for making a shaped fibrous article that includes introducing a dilute aqueous slurry containing mineral wool fibers, a clay binder and other binders into a forming tank. The dilute aqueous slurry has between about 1% and 5% solids by weight.

The dilute slurry in the forming tank is circulated to maintain the solids substantially uniformly distributed therein. A perforated or foraminous member is positioned in the circulating slurry in the forming tank. Suction is applied to an internal portion of the foraminous member and a layer of solids in the slurry is accreted on the outer surface of the foraminous member. The outer surface of the layer of the accreted solids is trimmed while the accreted solids are on the foraminous member to thereby form a shaped article having an inner surface with the configuration of the outer surface of the foraminous member and an outer surface of a preselected configuration. The shaped article is thereafter removed from the foraminous member and dried to remove substantially all of the liquid in the layer of accreted solids.

Where a perforated or foraminous mandrel is employed, the dilute slurry is introduced tangentially into the forming tank at several elevations and circulated toroidally within the forming tank. The perforated or foraminous mandrel is lowered into the forming tank and into the toroidally circulating slurry therein. The mandrel is rotated at a preselected speed and preferably in a direction opposite to the direction of rotation of the slurry circulating in the forming tank. After a substantially uniform layer of solids is deposited on the outer surface of the mandrel, the mandrel is removed from the forming tank and a reduced vacuum is applied to the mandrel to further remove liquid from the layer of accreted solids on the mandrel. The outer surface of the accreted solids while on the mandrel is trimmed by means of a saw to provide an outer surface having a generally cylindrical configuration. The trimmed cylindrical article is then sprayed with a coating material while the vacuum is maintained on the mandrel and the so treated article is thereafter removed from the mandrel and dried at a temperature preferably below 400°F.

The filtrate withdrawn through the foraminous mandrel contains between 1 and 3% by weight solids and is recirculated to a slurry preparation tank where the filtrate is admixed with additional mineral wool fibers, a clay binder and other binders to form the dilute slurry containing between 1 and 5% solids by weight.

The fibrous shaped article has a substantial portion of the fibers in the accreted solids oriented substantially parallel to the outer or forming surface of the foraminous member. The fibrous shaped article has a density of between 7 and 20 pounds per cubic foot and preferably between 11 and 14 pounds per cubic foot. The flexural strength of the fibrous shaped article is greater than 50 pounds per square inch and in a preferred range of between 60 and 70 pounds per square inch.

The thermal conductivity of the shaped fibrous article at a mean temperature of about 500°F. is about 0.51 Btu. in./hr. ft.$^2$ °F.

Apparatus may be provided for a multi-station forming machine where a plurality of mandrels are mounted on arms extending radially from a rotary indexing head so that a plurality of shaped fibrous articles may be simultaneously formed.

Accordingly, the principal object of this invention is to provide a process for making a fibrous shaped article having a substantial portion of the fibers oriented substantially parallel to the outer or forming surface and further having desirable physical strength and insulating properties.

Another object of this invention is to provide a process for making a fibrous shaped article that does not require apparatus for shaping the outer surface of the article during the accretion of solids on the foraminous member or during removal from the forming tank.

These and other objects of this invention will be more completely described and disclosed in the following specification, the accompanying drawings and the appended claims.

BRIEF DESCRIPTION OF THE DRAWINGS

FIG. 1 is a perspective view of suitable apparatus for forming a fibrous shaped article from a slurry.

FIG. 2 is a diagrammatic view of the process for forming and circulating the slurry and filtrate.

DESCRIPTION OF THE PREFERRED EMBODIMENTS

Referring to the drawings and particularly to FIG. 2, there is illustrated diagrammatically the circulating system for the slurry and includes a slurry preparation tank where the following solids are admixed with water or filtrate to form a dilute aqueous slurry having a solids content of between 1 and 5% by weight and preferably between 3 and 4% solids by weight. A suitable formulation of the constituents other than water that are present in the slurry is set forth below, and the constituents are indicated in weight percent of solids. It should be understood that other constituents or other proportions of the constituents may be used without departing from the invention.

| Constituent | % by weight |
|---|---|
| Mineral fiber | 81 |
| Clay | 16 |
| Starch | 3 |
| Alumina | 0.6 |
| Flocculent | 0.014 |

A suitable water repellent may be added to the slurry to waterproof the fibrous article made therefrom. A preferred water repellent is a surface active material that is non-ionic. The above constituents are admixed in a preselected sequence, as later discussed, with water and preferably with the recycled filtrate to form a slurry having between about 1 and 5% solids by weight and preferably between about 3 and 4% solids by weight. The mineral fiber is preferably an inorganic wool, such as Texas rock wool, formed from furnace slag. A suitable rock wool includes the following principal constituents:

| Constituent | % by weight |
|---|---|
| $SiO_2$ | 42 |
| CaO | 18 |
| $Fe_2O_3$ | 21 |
| MgO | 4 |
| $Al_2O_3$ | 7 |

The clay binder is preferably a clay having the properties of M & D ball clay which is mined by the Kentucky - Tennessee Clay Company in the vicinity of Crenshaw, Miss. A detailed description of M & D ball clay and its properties is set forth in U.S. Pat. No. 3,371,134. The M & D ball clay is preferably subjected to high shear mixing as a concentrated slurry to obtain maximum surface area before it is introduced into the slurry preparation tank.

One of the other binders is preferably a colloidal alumina which is manufactured as a co-product with normal primary alcohols such as that sold by Continental Oil Company under the trademark "Dispal-M". The colloidal alumina may also be subjected to a high shear mixing in an acidic concentrate slurry. Another binder is a starch that may be a conventional cornstarch which may or may not require cooking to develop the bonding properties of the starch. Biocides may be added to control the bacterial action of the starch while retaining the binder properties of the starch. The flocculent is preferably a high molecular weight acrylic polyelectrolyte. A suitable flocculent is sold by Hercules, Inc. under the trademark "Reten 421" and is defined as an anionic water soluble polymer.

The above constituents are thoroughly mixed in the slurry preparation tank and may be added in random order. It is preferred, however, that the alumina binder be added to the slurry after the treated clay slurry and starch slurry are introduced into the slurry preparation tank. The fibers are thereafter added to the above admixture. It is believed that preparation of the slurry in the above order improves the strength of the fibrous shaped article formed therefrom. It should be understood that the abovve formulation of solids may be varied without departing from the invention.

The slurry preparation in the slurry preparation tank 10 is conveyed through a suitable conduit 12 to a holding tank 14. The slurry in the holding tank 14 is continuously circulated to maintain the fibers uniformly dispersed therein. During forming the slurry is also circulated through an endless conduit 16 to and from the holding tank 14. A portion of the slurry circulated through the conduit 16 is introduced into the forming tank 18 at different elevations, as will be later discussed in reference to FIG. 1.

The slurry is introduced into the forming tank so that it flows in a toroidal pattern to assist in maintaining the fibers and solids uniformly dispersed in the slurry and to assist in providing a uniform accretion of the fibers and the solids on the foraminous mandrel. A suitable mixer may also be positioned in the forming tank to assist in providing a toroidal pattern therein.

The filtrate is withdrawn through the foraminous member positioned in the forming tank 18 by a vacuum pump 20 connected to the foraminous member by conduits 21 and 22. The filtrate is conveyed from the foraminous member through conduit 22 to a vacuum receiver 24. From the vacuum receiver 24 the filtrate flows through conduit 26 to filtrate holding tank 28.

The filtrate contains between 1 and 3% solids by weight and stabilizes at this solids content so that the filtrate may be re-used in the process to make up other slurry having a solids content of between 1 and 5% by weight and preferably between 3 and 4% by weight solids. With this arrangement, it is not necessary to discard the filtrate and it eliminates equipment required to treat the filtrate before the filtrate is discarded. The filtrate is continuously recycled in the process and stabilizes to obtain a solids content of between 1 and 3% by weight. The filtrate thus remains at this solids level and is introduced from the filtrate holding tank 28 into the slurry preparation tank 10 through conduit 30 in the slurry preparation tank 10. Sufficient solids are introduced into the filtrate to obtain a slurry having the desired solids content.

Referring to FIG. 1, there is illustrated suitable apparatus for forming a fibrous pipe covering by the vacuum forming process. The forming tank previously designated by the numeral 18 is positioned on a platform 32. The re-circulating conduit 16 has a re-circulating pump 34 connected thereto for re-circulating the slurry to and from the holding tank 14 during the forming operation. The conduit 16 has a vertical leg 38 with a plurality of branch conduits 40, 42 and 44 connected thereto at different elevations. The conduits 40, 42 and 44 have outlet openings connected to the forming tank 18 and are arranged tangential with the tank 18 to provide for toroidal circulation of the slurry in the forming tank 18. With this arrangement, a portion of the slurry re-circulated through conduit 16 flows through the outlet conduits 40, 42 and 44 into the forming tank 18 at different elevations. Suitable valve means may be provided in the branch conduits 40, 42 and 44 to control the amount of slurry introduced into the forming tank and the forming tank 18 has a suitable overflow conduit (not shown) for conveying the overflow slurry to the holding tank 14. The toroidal circulation of the slurry within the forming tank 18 maintains the solids substantially uniformly distributed therein.

A support column 46 is mounted on the platform 32 and has a suitable internal drive to rotate an indexing head 48 supported thereon. The indexing head 48 has a pair of arms 50 and 52 extending radially therefrom. The arms support mandrels at their end portions. Secured to the ends of the arms 50 and 52 are vertical channel supports 54 with an upper supporting frame 56 connected thereto. A pulley 58 is supported on the upper frame 56 and has a cable 59 reeved therearound. One end of the cable is connected to a mandrel support 60 that is slidably positioned on vertical channel 54. The cable 59 is reeved about a second pulley 62 that is secured to a counter-weight 64. The end of the cable 59 is secured to the frame 56. Suitable means are provided to rotate the pulley 58 to lower the mandrel 68 into the forming tank 18 and to raise the mandrel 68 from the forming tank with the accreted solids article thereon.

The mandrel support 60 has a vacuum conduit 66 connected thereto and also includes suitable drive means to rotate the foraminous mandrel 68. With this arrangement, the mandrel 68 is arranged to move vertically relative to the support frame 56 downwardly into the forming tank 18 and to be removed therefrom by moving upwardly relative to the forming tank 18 as illustrated in FIG. 1. The vacuum conduit 66 is connected at its other end to a connector 70 that is arranged to rotate with the indexing head 48. The conduit 22 from the rotatable connector 72 conveys the filtrate withdrawn through the mandrel to the vacuum receiver 24. Also, suitable valving may be provided in connector 70 to provide independent sources of suction or vacuum for each of the plurality of foraminous mandrels 68.

The foraminous mandrel preferably has a frame structure that supports a cylindrical metallic perforated outer sheet with the size of the apertures in the mandrel about 3/32 inch. It is desirable to provide suitable means within the mandrel 68 to exert substantially the same suction along the entire length of the mandrel to uniformly accrete the solids the outer surface thereof. The optimum open area on the mandrel is about 50% of the mandrel area to reduce the forming time of the shaped article thereon. The perforated sheet has about 30% open area. It is preferred that the mandrel have a metallic sheet to facilitate stripping the shaped article therefrom.

The mandrel 68 is lowered into the forming tank 18 and rotated in a direction opposite to the direction of the toroidally circulating slurry in forming tank 18 as illustrated in FIG. 1. A suction or vacuum of about 24 inches Hg. is applied through the conduit 66 to the inner portion of the mandrel 68. It is desirable to distribute the air flow in the mandrel by means of internals to obtain substantially no change in pressure drop throughout the length of the mandrel. This provides a uniform deposit of the solids on the mandrel. The mandrel is rotated within the forming tank 18 while the suction is applied thereto. The solids in the slurry are deposited on the external surface of the mandrel 68 and the filtrate flowing through the foraminous mandrel is withdrawn through the suction conduit 66. Rotation of the mandrel provides a uniform deposit of solids thereon, i.e. a substantially cylindrically shaped deposit as distinguished from an elliptically shaped deposit when the mandrel remains stationary. When a layer of solids of the desired thickness is accreted on the outer surface of the mandrel 68 to form a cylindrically shaped article, the mandrel is moved upwardly out of the forming tank. For example, when a thickness of 1 inch of solids is desired, the mandrel remains in the forming tank with the vacuum on for a period of about 35 seconds. Where a thickness of about 2 inches is desired, the mandrel remains in the forming tank for about a period of one minute. After the mandrel is removed from the forming tank, the vacuum reduces itself to a level not below 7 inches Hg. as additional liquid is removed from the accreted article while on the mandrel. The moisture content of the accreted article is reduced to between 40 and 65% by weight liquid by means of the vacuum or suction applied to the mandrel.

When the desired moisture of the accreted article is attained, the indexing head is then rotated so that the arm 50 is in the position of arm 52. The mandrel with the accreted cylindrical article 72 is then lowered into operative position adjacent a band saw 74 and the vacuum or suction is retained on the mandrel. The band saw 74 has an endless saw blade 75 having a vertical portion adjacent to the accreted article 72. The saw is actuated and the mandrel 68 with the accreted cylindrical article 72 thereon is rotated and the external surface of the cylindrically shaped article 72 is trimmed by means of the band saw 74. Thereafter the vacuum or suction on the mandrel is terminated or reduced to permit transverse expansion of the shaped article perpendicular to the forming surface. The mandrel 68 with the accreted cylindrical article 72 is again trimmed by the saw to provide a true cylindrical surface. It is desirable to trim the shaped article without suction being applied to the mandrel to provide a generally cylindrically shaped article as dintinguished from a barrel shaped article.

The band saw 74 is mounted on the platform 32 between guides 76 and is adjustable toward and away from the mandrel 68 by means of the adjusting device 78 to thus control the amount of the accreted article removed during the trimming operation. The lower portion of the mandrel 68 is suitably supported on a support 77 to maintain the mandrel in parallel relation with the saw blade 75 while the accreted cylindrical article 72 is being trimmed. The cuttings or trimmings removed from the cylindrical article 72 are suitably collected and returned to a suitable tank as wet recycle solids. The wet recycle solids are admixed with water and/or filtrate to form additional slurry. The drive for the mandrel mounted in the mandrel support 60 is preferably a variable speed drive to rotate the mandrel at preselected speeds during both the accretion of the solids on the mandrel and while the accreted cylindrical article 72 is being trimmed by the saw 74. After the cylindrical article 72 has been trimmed, the indexing head 48 is rotated to a location where the outer surface of the cylindrical article 72 may be sprayed with a suitable coating material, such as a spray containing about 11% by weight solids and including about 9% by weight M & D clay and 2% by weight starch.

After the coating has been applied to the cylindrical accreted article 72 the indexing head 48 rotates to a position adjacent the pallet 86. The mandrel is moved vertically several times and bumped against a fixed member to loosen the cylindrical article 72 from the mandrel 68. Other suitable means may be employed to remove the cylindrical article 72 from the mandrel 68. The mandrel is thereafter moved into overlying relation with the pallet with or without suction being applied to the mandrel and the loosened cylindrical article 72 is removed from the mandrel and positioned on the pallet 86. The cylindrical article 72 positioned on the pallet 86 has a moisture content of between 40 and 65% by weight liquid and is sufficiently rigid to be supported in the vertical position illustrated. Thereafter, the pallet 86 with a plurality of cylindrically shaped fibrous articles thereon is conveyed to a drying oven where the cylindrically shaped articles 72 are subjected to an elevated temperature and dried. A suitable moisture content of the shaped article after drying is about 1% moisture or less.

After the cylindrically shaped articles have been subjected to an elevated drying temperature, the cylindrical articles are cut longitudinally and the end portions are trimmed to provide a pair of semi-cylindrical pipe coverings arranged to be secured to a pipe having an outer diameter substantially equal to the inner diameter of the pipe covering. The dried trimmings are returned to a tank and admixed with filtrate and/or water to form additional slurry. Although the above was directed to cylindrical pipe coverings, it should be understood, utilizing foraminous members of different configurations, that accreted articles having other types of configurations as, for example, rectangular blocks and the like, can be formed with equal facility.

With the above arrangement, it is now possible to prepare a shaped fibrous article which is suitable as a mineral wool fiber insulation product. The shaped article has a density of between 7 and 20 pounds per cubic foot and preferably between 11 and 14 pounds per cubic foot determined according to ASTM Test C-203. The flexural strength of the mineral fiber insulation is greater than 50 p.s.i. and in a preferred range of between 60 and 75 p.s.i. The flexural strength is measured on one inch square about seven inches long, supported adjacent its ends. A continually increasing force is applied until the bar fails in accordance with ASTM Test C-203. The shaped article has an impact strength of about 0.139 ft./lbs. measured on an Izod Impact Tester in accordance with ASTM Test C-589. The shaped article thermal conductivity at a mean temperature of about 500°F. is about 0.51 Btu. in./hr. ft.$^2$ °F.

Although we do not wish to be bound by the following theory, it is believed that the superior strength of the shaped article, the low density and the superior insulation properties are attributable to the orientation of the fibers during the accretion of the solids on the foraminous member. A substantial portion of the fibers are oriented substantially parallel to the outer or forming surface of the foraminous member. Stated otherwise, the fibers in the insulation product are not randomly oriented and appear to be oriented parallel to the surface of the foraminous member. It is further believed that the manner in which the slurry is circulated in the forming tank and for cylindrical foraminous mandrels the manner in which the mandrel is rotated, concentration of solids in the slurry and the degree of vacuum employed during the forming operation also contribute to a certain extent to further orientation. As an example, where the fibers are oriented perpendicular to the forming surface, the shaped article has the following properties as above described:

| | Density | Flex Strength | K-Factor |
|---|---|---|---|
| Oriented Parallel | 13 psi | 50–60 psi | .51 at 500°F. |
| Oriented Perpendicular | 16–18 psi | 25–30 psi | .69 at 500°F. |

It is believed that the colloidal alumina improves substantially the binding characteristics of the shaped article. The fibers and clay have negatively charged surfaces and the alumina has a positively charged surface and it is believed that the surface of the clay and fibers are attracted to the alumina particles to thus coat the fiber surface with the clay. It has been found that there is a variation in density of the accreted product throughout its thickness and it is believed that there is a variation of the K-factor or insulation properties throughout the thickness of the shaped article dependent on the density. For example, a 3 inch thick shaped article had an overall density of 12.0 pounds per cubic foot and the adjacent forming surface of the shaped article had a density of about 15.8 pounds per cubic foot. From the above, it will be apparent that the shaped article has its best high temperature insulating properties adjacent the shaped article inner surface which in pipe insulation is adjacent the pipe that is to be insulated.

According to the provisions of the patent statutes, we have explained the principle, preferred construction and mode of operation of our invention and have illustrated and described what we now consider to represent its best embodiments. However it should be understood that, within the scope of the appended claims, the invention may be practiced otherwise than as specifically illustrated and described.

We claim:

1. A process for making a fibrous shaped article comprising, introducing a dilute aqueous slurry containing mineral wool fibers, a clay binder and other binders into a forming tank tangentially to the direction of circulation to toroidally circulate said slurry in said forming tank to maintain said solids substantially uniformly distributed therein, said slurry having between about 1 and 5% solids by weight, positioning a foraminous member in said circulating slurry in said forming tank so that said foraminous member is submerged in said slurry, applying a suction to an internal portion of said foraminous member and accreting a substantially uniform layer of said solids in said slurry on the outer surface of said foraminous member, maintaining said foraminous member submerged in said slurry while accreting said substantially uniform layer of said solids thereon, trimming the outer surface of said layer of accreted solids while said layer of accreted solids is on said foraminous member to form a shaped article having an inner surface with the configuration of the outer surface of said foraminous member and an outer surface of a preselected configuration, thereafter removing said shaped article from said foraminous member, and drying said shaped article to remove substantially all of the liquid in the shaped article of accreted solids.

2. A process for making a fibrous shaped article as set forth in claim 1 in which, said foraminous member comprises a mandrel having a cylindrical outer surface, positioning said mandrel vertically in said slurry in said forming tank while accreting solids thereon to form a substantially cylindrically shaped article of accreted solids.

3. A process for making a fibrous shaped article as set forth in claim 2 which includes, rotating said mandrel in said forming tank while accreting said solids thereon.

4. A process for making a fibrous shaped article as set forth in claim 3 which includes, rotating said mandrel in a direction opposite to the direction of circulation of said slurry.

5. A process for making a fibrous shaped article as set forth in claim 1 which includes, removing said foraminous member from said forming tank and maintaining suction on said foraminous member to reduce the water content of said accreted solids to between about 40 to 65% water by weight.

6. A process for making a fibrous shaped article as set forth in claim 5 which includes, trimming the outer surface of said accreted solids on said foraminous member while said accreted solids contain between about 40 and 65% liquid by weight.

7. A process for making a fibrous shaped article as set forth in claim 1 which includes, introducing said slurry at a plurality of different elevations into said forming tank to maintain said solids in said slurry uniformly distributed therein.

8. A process for making a fibrous shaped article as set forth in claim 1 which includes, withdrawing the filtrate formed by the accretion of said solids on said foraminous member through an internal portion of said foraminous member, said filtrate containing between about 1 and 3% solids by weight, recirculating said filtrate to a slurry preparation tank, adding mineral wool fibers and binders to the filtrate to form said dilute slurry.

9. A process for making a fibrous shaped article as set forth in claim 2 which includes, positioning said mandrel with said layer of accreted solids thereon in abutting relation with an endless saw blade, moving said saw blade relative to said layer of accreted solids while rotating said mandrel, and trimming the layer of said accreted solids with said saw blade to form a shaped article having a generally cylindrical outer surface.

10. A process for making a fibrous shaped article as set forth in claim 9 which includes, maintaining a suction on said mandrel while trimming said layer of accreted solids with said saw blade, thereafter terminating the suction on said mandrel and trimming said layer of said accreted solids a second time with said saw blade to form a shaped article having a generally cylindrical outer surface.

11. A process for making a fibrous shaped article as set forth in claim 1 which includes, spraying a coating material on the outer surface of said shaped article while said shaped article remains on said foraminous member, applying suction to said foraminous member while spraying said coating material on the outer surface of said shaped article so that the coating material penetrates the outer surface of said shaped article.

* * * * *